US005632629A

United States Patent [19]

Legrady

[11] Patent Number: 5,632,629

[45] Date of Patent: May 27, 1997

[54] MOUNT ELECTRICAL CONNECTORS

[75] Inventor: Janos Legrady, Putnam Valley, N.Y.

[73] Assignee: Zierick Manufacturing Corporation, Mt. Kisco, N.Y.

[21] Appl. No.: 554,342

[22] Filed: Nov. 6, 1995

Related U.S. Application Data

[63] Continuation of Ser. No. 121,206, Sep. 14, 1993, abandoned.

[51] Int. Cl.[6] ..... H01R 9/09

[52] U.S. Cl. ..... 439/78; 439/83; 439/885

[58] Field of Search ..... 439/78, 83, 825, 439/876, 884, 885; 29/842, 843

[56] References Cited

U.S. PATENT DOCUMENTS

| | | | |
|---|---|---|---|
| 3,375,486 | 3/1968 | Clayton . | |
| 3,428,934 | 2/1969 | Reider, Jr. et al. . | |
| 3,663,931 | 5/1972 | Brown . | |
| 3,742,432 | 6/1973 | Curtis et al. | 439/884 X |
| 3,864,014 | 2/1975 | Lynch . | |
| 4,017,142 | 4/1977 | Clark et al. . | |
| 4,369,572 | 1/1983 | Atkins . | |
| 4,395,087 | 7/1983 | Gorre et al. . | |
| 5,073,132 | 12/1991 | Nottrott . | |
| 5,178,564 | 1/1993 | Kachlic et al. | 439/78 X |
| 5,188,547 | 2/1993 | Dixon et al. | 439/884 X |

OTHER PUBLICATIONS

Research Disclosure, Jul. 1990, No. 315.

*Primary Examiner*—Khiem Nguyen
*Attorney, Agent, or Firm*—Lackenbach Siegel Marzullo Aronson & Greenspan, P.C.

[57] ABSTRACT

A surface mounted connector for surface mounting on a generally flat conductive surface of a printed circuit board includes a base which has a generally flat surface suitable for contact with an attachment to a conductive surface of the printed circuit board. An electrical contact, which may be in the form of a pin, post, IDC, test point, or receptacle, has at least one portion projecting from the base in a direction normal to the base. At least one bent intermediate connecting portion integrally connects the contact to the base. The contact, base and the bent intermediate connecting portions are all formed from a generally flat sheet of conductive material. A blank for the surface mounted connector, as well as a rolled strip of connectors is disclosed.

26 Claims, 10 Drawing Sheets

FIG. 15
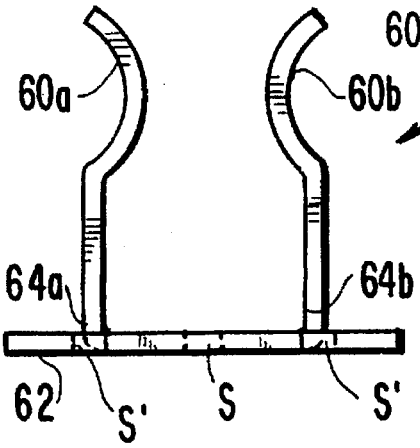
FIG. 16
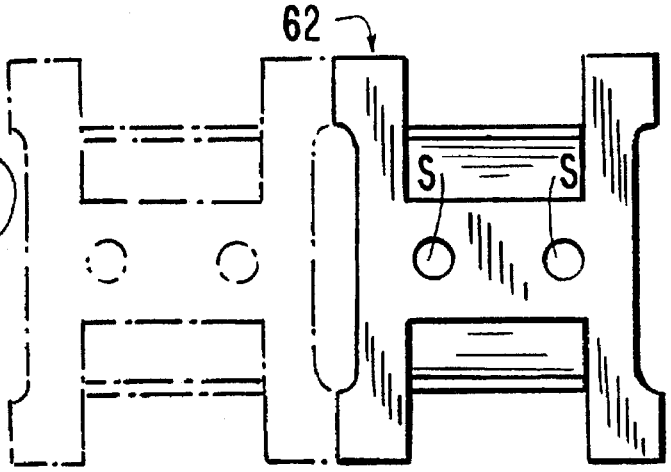
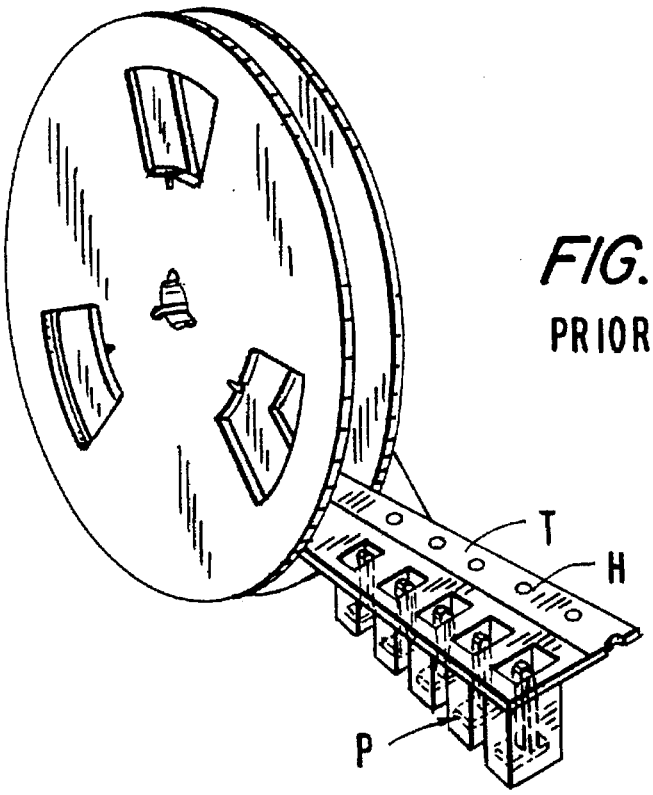
FIG. 17
PRIOR ART

MOUNT ELECTRICAL CONNECTORS

This application is a continuation of application Ser. No. 08/121,206, filed Sep. 14, 1993 now abandoned.

BACKGROUND OF THE INVENTION

The invention generally relates to electrical connectors, and more specifically, to surface mounted electrical connectors that can be mounted on the surfaces of printed circuit boards by automated surface component mounting equipment, capable of sequentially picking up the electrical connectors, one at a time, and transferring them from a pick-up station to a mounting station for accurately mounting on a printed circuit board.

Numerous electrical connector designs have been proposed for mounting on printed circuit boards. Many of these are for pins or posts that are formed by stamping flat sheet stock. In many cases, the pins or posts are initially connected to each other by a carrier strip to allow automated mounting on a printed circuit board. The aforementioned pins or posts take on different shapes, including relatively flat shapes as shown in U.S. Pat. No. 5,073,132. Thin flat posts are shown in U.S. Pat. No. 3,864,014. Box-type male connectors are illustrated in U.S. Pat. No. 3,375,486. Relatively large cross-section pins are also disclosed in U.S. Pat. Nos. 4,017,142 and 3,428,934.

In U.S. Pat. Nos. 4,395,087 and 3,663,931, substantially square, solid pins are utilized for the electrical contacts. In the '087 patent, the pins are mounted on a carrier strip while in the '931 patent a unitary pin is shown formed integrally with a socket contact, presumably formed out of stamped material. In U.S. Pat. No. 4,369,572, a substantially solid rectangular pin is shown welded to the carrier strip. However, none of the known designs disclose pin connectors formed from flat sheet stock adapted or suitable for surface mounting on a printed circuit board.

It is also known to provide single loose surface mount pin terminals each packaged in individual plastic pockets P carried by a plastic pocket carrier or tape T, as shown in FIG. 17 tape. However, the aforementioned approach has a number of problems and has not found wide acceptance in the industry. To begin with, the additional plastic pockets or envelopes P have increased the per unit costs of the surface mounted components. Additionally, because the surface mounted pins are contained within a normally oversized pocket or enclosure, the components have at least some degree of freedom of movement therein and this has made it difficult and impractical to precisely align the components at the pick-up stations of the automatic pick-and-place equipment with the vacuum nozzles used for this purpose, notwithstanding the sprocket or pilot holes H intended to accurately align the pins. Such machinery demands very accurate alignment of the parts during pick-up and even small misalignments from the required positions may cause damage to the parts and/or to the nozzles themselves.

In view of the foregoing, although significant advancements have been made in the design and use of pick and place equipment, such machinery has primarily been used to pick and place components that have a sufficiently large surface to provide a suction area for the nozzles. As such, such machinery has primarily been used to pick and place transistors, ICs, capacitors, and numerous other electrical components that provide the requisite surfaces. However, because electrical posts, test points, IDC's and other electrical receptacles have not always exhibited the requisite geometries suitable for pick and place equipment, it has not always been possible to automate the mounting of such components utilizing surface mount technology.

Until now, therefore, surface mount posts were packaged in header form utilizing a plastic body to hold a row of components and placed on the board by a pick-and-place robot. If there was a need for test points, tabs, IDCs or any other type of single terminal, the board and the manufacturing process had to be a combination of surface mount technology and through-hole technology, because those terminals were available for through-hole technology only.

SUMMARY OF THE INVENTION

Accordingly, it is an object of the present invention to provide surface mount electrical connectors that do not possess the disadvantages inherent in prior art surface mount connectors.

It is another object of the present invention to provide surface mount electrical connectors that are simple in construction and economical to manufacture.

It is still another object of the present invention to provide a surface mount electrical connector that can readily be used with pick-and-place automated surface mount equipment.

It is yet another object of the present invention to provide surface mount electrical connectors that can be efficiently mounted on printed circuit boards while substantially eliminating all waste due to damage to such connectors.

It is a further object of the present invention to provide surface mount electrical connectors of the type mentioned in the previous objects that can be in the forms of mounting posts, test points, IDCs and female receptacles.

It is still a further object of the present invention to provide surface mount electrical connectors of the type aforementioned that can be inexpensively produced by using continuous stamping technology and without the need for individual packages or tapes to carry the conductors.

The present invention provides a new family of surface mount terminals that can readily and efficiently be utilized with associated feeders for use with pick-and-place equipment to eliminate the need for the combination surface mount/through-hole technologies.

In accordance with the present invention, a surface mount connector for surface mounting on a generally flat conductor surface of a printed circuit board comprises a base defining a plane and having a generally flat surface suitable for contact with and attachment to an associated flat conductive surface of the printed circuit board. A contact has at least one portion projecting from said base in a direction substantially normal to said plane defined by said base. At least one bent intermediate connecting portion integrally connects said contact to said base, said contact, base and at least one bent intermediate connecting portion all being integrally formed of a generally flat sheet of conductive material. The contact portion of the connector may be in the form of an electrical pin, a test point, an electrical female receptacle or an electrical insulation displacement connector (IDC).

When used with automated pick-and-place machinery, a strip of series connected surface mounted connectors are provided with frangible connecting means between each two adjacent connectors. In this manner, a strip of connectors can be advanced to an automated mounting station and a connector at the downstream end of the strip can be separated from the strip by severing said frangible connecting means between said connector at the downstream end and the adjacent immediately succeeding connector in the strip. Preferably, the series connected surface mounted connectors are helically wound on a spool or bobbin so that the strip can be unwound and advanced to an automated mounting station.

The present invention also contemplates blanks for forming a surface mounted connector and a plurality of series-connected surface mounted connectors in accordance with the present invention, as well as the method of forming such connectors.

BRIEF DESCRIPTION OF THE DRAWINGS

This and other objects and features of the present invention will become clear from the following description taken in conjunction with preferred embodiments thereof with reference to accompanying drawings, in which:

FIG. 15 is a front elevational view of a further embodiment of a surface mounted connector in accordance with the present invention in the nature of a fuse holder;

FIG. 16 is a top plan view of a pair of fuseholders of the type shown in FIG. 15, illustrating how the connectors are joined to each other in a strip and illustrating holes formed in the bases of the connectors to enhance capillary action during soldering on a printed circuit board; and FIG. 17 is a perspective view of a spool of surface mounted pins in accordance with the prior art wherein individual pins are contained within pocket carriers serially mounted on a tape helically wound on a reel.

DESCRIPTION OF THE PREFERRED EMBODIMENTS

Figure 1:
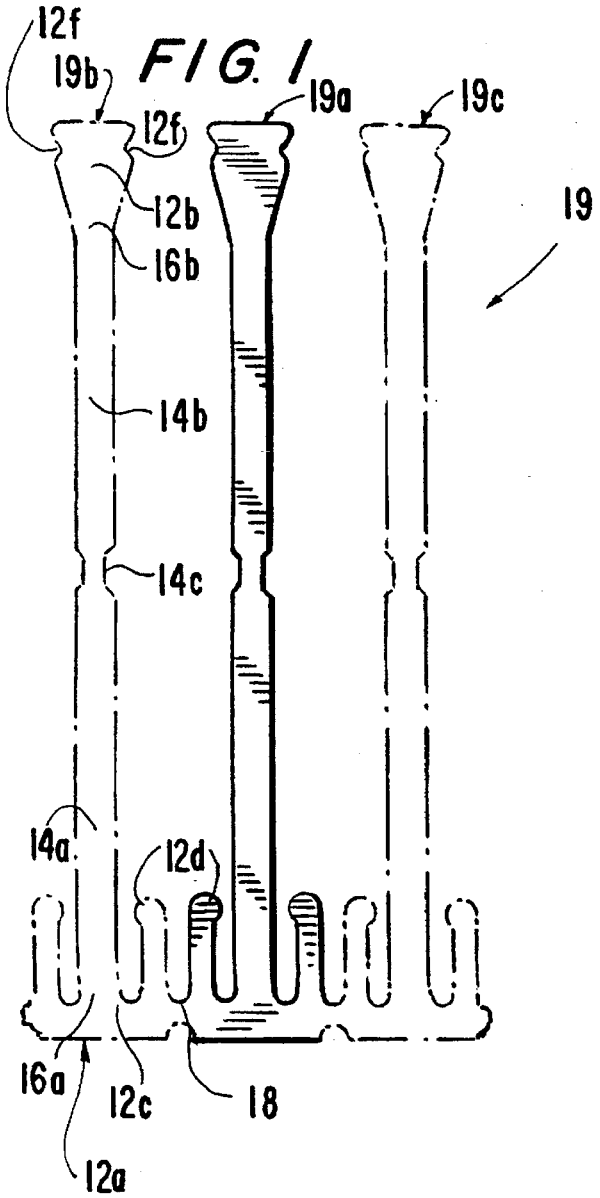
FIG. 1 is a perspective view of a surface mounted connector in the nature of a test point or male contact pin in accordance with the present invention, shown in its individual form after being severed from a strip of such connectors and ready to be surface mounted on a printed circuit board.

Referring now specifically to the Figures, in which identical or similar parts are designated by the same reference numerals throughout, and first referring to FIG. 1, an electrical connector or contact suitable for mounting on the surface of a printed circuit board (PCB) is generally designated by the reference numeral 10.

The connector 10 includes a base 12 which defines a plane and has a generally flat surface suitable for contact with and attachment to a flat conductive surface of a printed circuit board frequently referred to as a "land" or "pad". An electrical contact pin 14 has at least one portion projecting from the base 12 in a direction substantially normal to the plane defined by the base. At least one bent intermediate connecting portion integrally connects the contact 14 to the base 12. In the construction shown in FIG. 1, two intermediate bent connecting portions **16*a* and 16*b* respectively connect the first contact portion 14*a* to a first base portion 12*a* and a second contact portion 14*b* to a second base portion 12*b***.

The uppermost ends of the first and second contact portions **14*a*, 14*b*, which are juxtaposed to each other as indicated, are joined to each other by an integral bent bridging portion 14*c*. The juxtaposition of the contact portions 14*a*, 14*b* as shown creates a narrow gap or space 14*d* which permits the surface mounted pin design to take advantage of capillary action during solder reflow. At least one of the two thin strips of 14*a*, 14*b* are plated and when the base 12 of the pin terminal is exposed to melted solder paste, the capillary attraction makes the liquid solder rise up inside the gap 14*d* to solder the two halves 14*a*, 14*d*** together forming a solid pin that can be used either as a contact pin or test point. The designs of other surface mounted connectors in accordance with the invention that promote capillary action and the advantages thereof will be discussed below.

An important feature of the present invention is that the electrical contact, such as the contact pin 14 in FIG. 1, including the base 12 and the intermediate connecting portions **16*a*, 16*b*, is formed of a generally flat sheet of conductive material, as will now be discussed in connection with FIG. 2**. Such construction allows for the economical manufacture of the surface mount electrical connectors and, equally importantly, it allows the connectors to be produced in elongate strips, as will be discussed hereafter, which facilitates the accurate positioning of the electrical connectors in pick-and-place equipment and to make such connectors viable and practical to use with such equipment.

Figure 2:
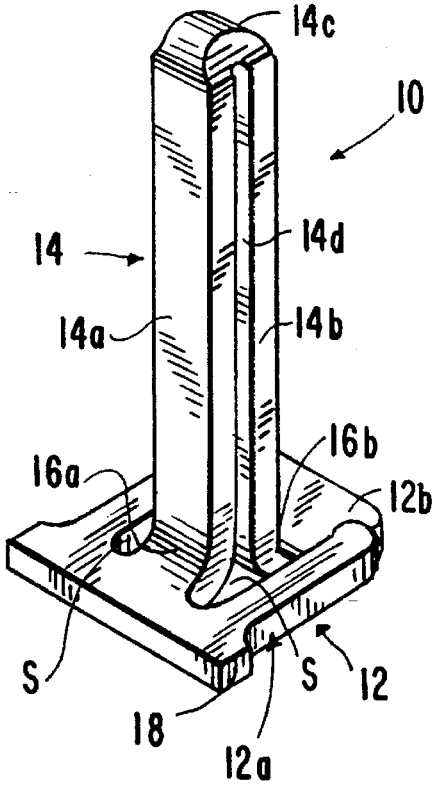
FIG. 2 is a plan view of a blank for a plurality of series-connected surface mounted connectors of the type shown in FIG. 1, showing one connector in solid outline, while downstream and upstream connectors in relation thereto are shown in phantom outline.

Referring to FIG. 2, a blank 19 is illustrated from which the connector 10 of FIG. 1 is made. The blank 19 is preferably for a plurality of series connected surface mounted connectors, as shown, which is formed as a stamping from an elongated strip of a flat sheet of electrically conducted material which includes like blank portions successively stamped along the strip as shown. Only the center blank 19*a* is shown in solid outline, a downstream immediately adjacent blank 19*b* and an upstream adjacent blank 19*c* being illustrated in phantom outline. All the blanks are similarly constructed and joined to each other by a frangible connecting tab strip or carrier 18 which connect adjacent blanks to each other. Each blank generally includes a base suitable for attachment to an associated surface of a printed circuit board, a contact and at least one intermediate connecting portion integrally connecting the contact to the base, as aforementioned in connection with FIG. 1. In connection with the specific blank shown in FIG. 2, utilized to produce the contact pin 14 of FIG. 1, the first base portion 12*a* is shown to include a generally U-shaped member having two parallel segments 12*c* on opposite sides of the contact portion 14*a*, and each having inwardly projecting protuberances 12*d* as shown. The two parallel segments 12*c* are joined to a transverse segment 12*e*, which is also joined, at its center, with the contact portion 14*a* by means of the intermediate connecting portion 16*a*. The bridging portion 14*c* is shown as a narrowed or necked down portion between the first and second contact portions 14*a*, 14*b*. At the upper or free ends of the contact portions, as viewed in FIG. 2, the second base portion 12*b* is provided as an outwardly tapered portion provided with opposing or lateral indentations 12*f*. As is clear from FIG. 1, the dimensions of the second base portion 12*b* are selected so as to be received within and substantially fill the area between the segments 12*c* when the base portions 12*a*, 12*b* are all moved into a common plane of the base 12. Once the blanks have been formed, as shown in FIG. 2, the surface mounted connector 10 is formed by deforming the blank so as to impart an approximately 90° bend in the first intermediate connecting portion 16*a*, thereby moving the first base portion 12 into a plane substantially normal to the first contact portion 14*a*. The second contact portion 14*b* is then bent 180° in relation to the first contact portion 14*a* about the bridging portion 14*c* so as to bring the contact portions 14*a* and 14*b* into juxtaposed position as shown in FIG. 1. Finally, the second base portion 12*b* is moved into the plane of the first base portion 12*a* by imparting a bend of 90° to the second intermediate connecting portion 16*b*, and positioning the protuberances 12*d* into the indentations of 12*f* as shown in FIG. 1. Other surface mounted connectors can be formed by the steps of forming a blank as described or by slightly modified steps as will be from the description that follows to those skilled in the art to apply the present invention to numerous other surface mounted connector designs. It will be appreciated that the combination of protuberances 12*d* and indentations 12*f* provide a locking mechanism which prevents the first and second base portions 12*a*, 12*b* and first and second contact portion 14*a*, 14*b* from separating, particularly prior to assembly or mounting on a printed circuit board. The design maintains the integrity of the contact pin or test point in its desired configuration during processing in the pick and place equipment, including severing a connector from the strip, gripping the connector at the pick up point, and placing the connector on a land on the printed circuit board to which it is to be soldered. Therefore, even though the connector is stamped from flexible sheet material, which exhibits some resiliency or "memory," the connector enjoys the advantages of a solid pin. Of course, after the connector 10 has been soldered to a printed circuit board, the contact portions 14*a*, 14*b* effectively become a solid pin by virtue of the capillary action of the solder which flows into and fills the gap or space 14*d*.

The flat base 12 of the embodiments of FIGS. 1 and 2 is preferably square in configuration, to conform to lands or pads on printed circuit boards which frequently are also square. However, this is not a critical feature of the present invention and it should be clear that the area defined by the flat base 12 can be any desired or selected area by selecting by appropriate dimensions for the various base portions which have been described. Also, with the base configuration shown in FIGS. 1 and 2, it will be appreciated that with exception of the central area, the flat base 12 presents a substantially solid surface for providing significant contact and adhesion to a land or pad on the printed circuit board. However, there are provided at least some open regions S in the center of the base. As suggested above, the solder will, by capillary action, rise into the open spaces "S" and into the pin 14 and, therefore, also provide adhesion to the printed circuit board in that central region. Preferably, in all the designs utilizing the present invention, the bases of the connectors exhibit substantial solid metal surfaces provided with openings or apertures S that are relatively small to take full advantage or benefit from capillary action, so that the connectors can be drawn to and attached to the printed circuit board when the solder reflows into the spaces S. This generally occurs with minimum float or lateral shifting because the rising of the reflowing solder draws the base towards the surface of the PCB with an effect not unlike a suction-cup effect. This is important because the pick-and-place equipment provides the greatest precision in the surface mounting process and the undesired shifting of components during reflow of the solder may misalign a component after accurately placed by the machine. The flow of solder into spaces S of the bases or into the space or gap 14*d* of the contact pin 14 (FIG. 1), which effectively absorb excess solder, to draw the bases to the PCB surfaces, has the additional advantage of rendering tolerances of the base and PCB land or pad dimensions less critical.

The spaces S (or gap 14*d*) should have dimensions that will provide capillary action, as aforementioned. Such dimensions will depend on numerous factors, including the nature of the solder paste, how clean and large the board and/or the contact surface area is, how level the board is, etc. Numerous technical papers have been written about the properties of solder that deal with the related topics of surface tension, wetting angles and capillary action. See, for example, "University Physics," Sears and Zemansky, 2nd Edition, Addison-Wesley Publishing Company, Inc., 1957, pages 231–235; "Testing SMDs for Solderability," B. M. Allen, "Surface Mount Technology" October 1988, pps 17–18; "The Assessment of the Solderability of Surface Mounted Devices Using the Wetting Balance", Yoshida et al, International Tin Research Institute Report. Those skilled in the art can, knowing all the relevant factors, determine what those dimensions should be. The number of spaces S, their dimensions, and/or their arrangement is not critical as long as they provide the desired capillary action.

Figure 3:
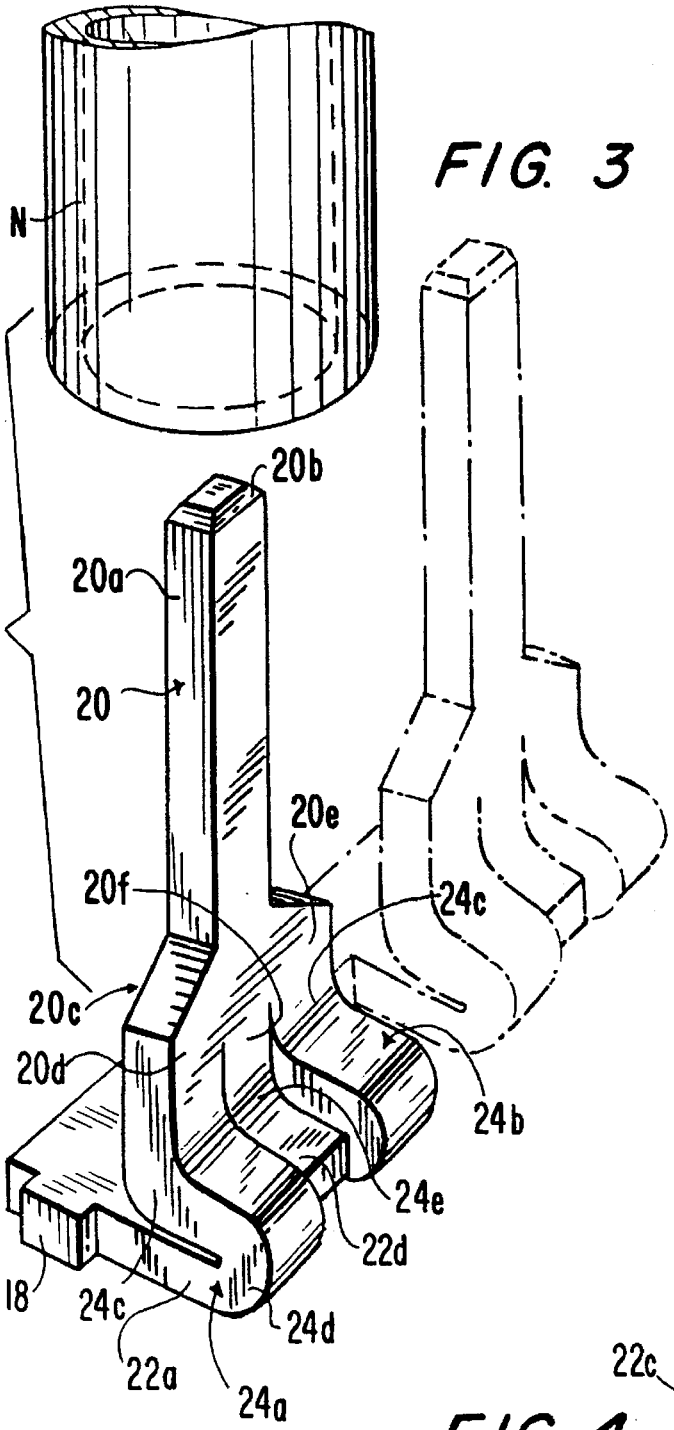
FIG. 3 is a perspective view of another embodiment of a surface mounted connector in accordance with the present invention, also in the form of a contact pin, and schematically illustrating a vacuum pick up nozzle positioned over the connector at the downstream end of the strip for picking up the connector after being severed from the strip.
Figure 4:
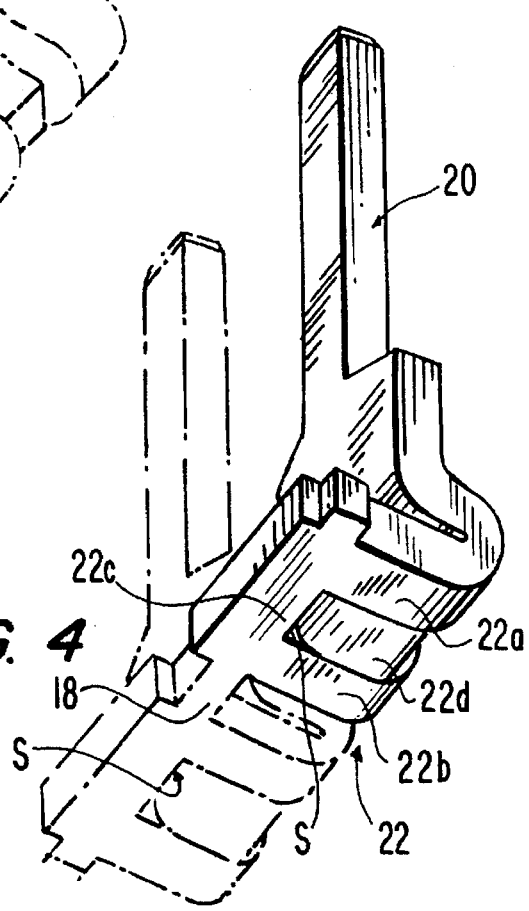
FIG. 4 is a bottom perspective view of the connector shown in FIG. 3, showing the details of the base construction as well as the manner in which the connectors are joined to each other by means of connecting tabs or carrier strips.

Referring to FIGS. 3 and 4, another embodiment in accordance with the invention is shown in the form of a contact pin 20. The contact pin 20 includes an upper contact member 20*a* which is advantageously provided with a beveled upper or free end 20*b* to facilitate insertion into a female contact receptacle. The base 22, as with the embodiment shown in FIGS. 1 and 2, is generally U-shaped and includes parallel spaced portions 22*a*, 22*b*, transverse portion 22*c* and solder absorbing space S as shown. The upper contact member 20*a*, in the region of the base 22, flares out or widens to the width of the base 22 as shown and defines a plurality of depending portions which are substantially co-planer with the central contact member 20*a*. In FIGS. 3 and 4, the enlarged shoulder 20*c* includes first and second side depending portions 20*d*, 20*e* and a center depending portion 20*f*. A separate bent intermediate connecting portion connects each of the depending portions with an associated base portion. Thus, the first side depending portion 20*d* is connected to the base portion 22*a* by connecting portion 24*a*, which includes first and second bent portions 24*c*, 24*d*. Similarly, connecting portion 24*b* connects the side depending portion 20*e* to the base portion 22*b*. In order to maximize the area or contact surface of the base with the printed circuit board and provide a solder-receiving space S, the center base portion 22*d*, which is an extension of the center depending portion 20*f*, joined at the bent portion 24*e*. Bent portions 24*c* and 24*e* are bent 90°, while bent portions 24*d* are bent 180° as shown. As with the contact pin 14, the bases are joined to each other by means of connecting or carrier tabs 18 which are selectively severed when the connector at the downstream end of the strip is about to be picked up by the mounting equipment, as suggested by the vacuum pick up nozzle N in FIG. 3.

Figure 5:
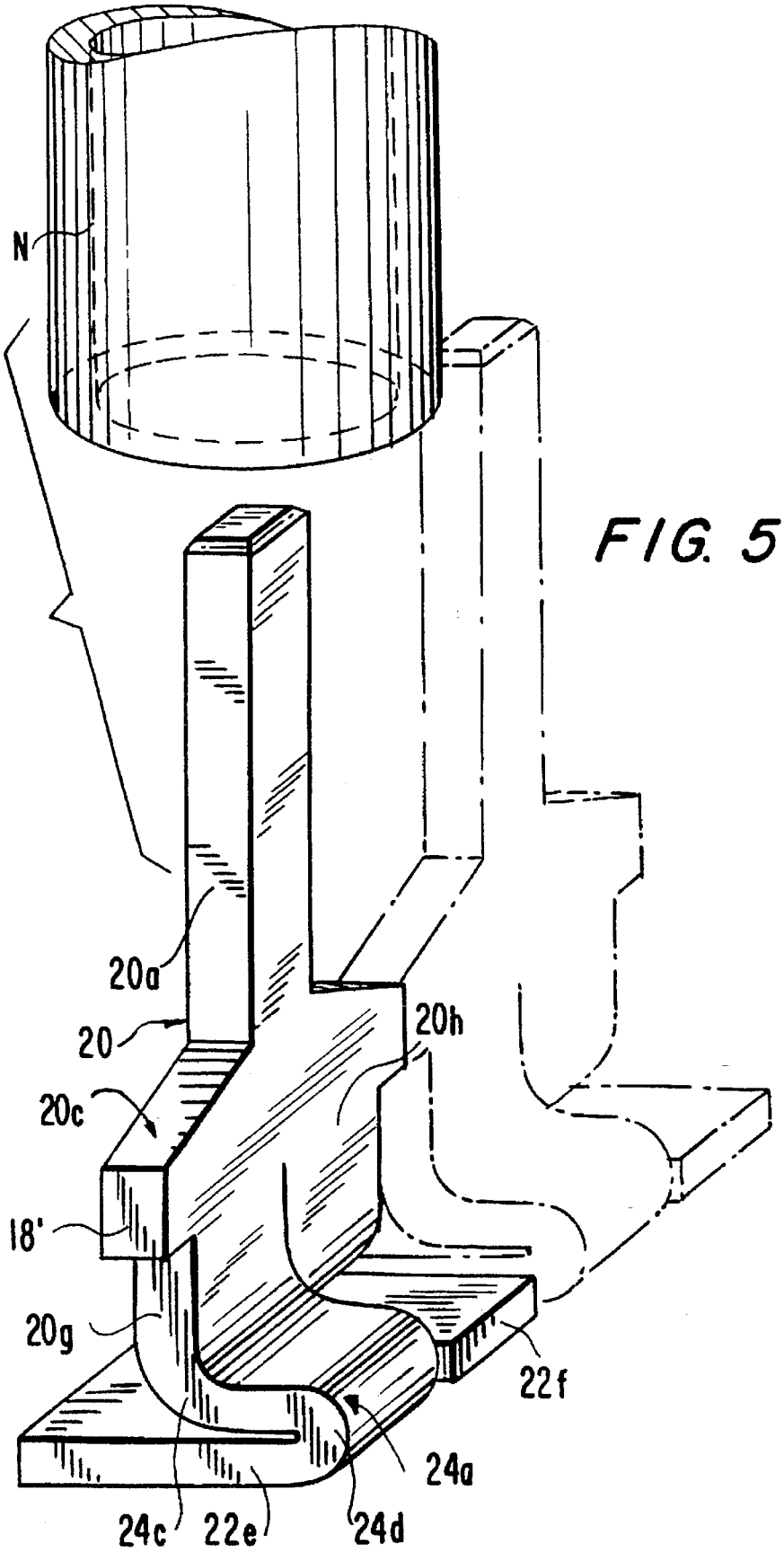
FIG. 5 is similar to FIG. 3, but showing a still further embodiment of a surface mounted connector in accordance with the present invention, in which adjacent connectors in the strip are joined to each other at a portion of the contact pins instead of at the bases.

In FIG. 5, a pin generally similar to that shown in FIGS. 3 and 4 is illustrated, except that only two base portions are provided. Thus, the enlarged shoulder portion 20*c* is configured as shown in order to provide a first depending portion 20*g* and second depending portion 20*h*. While the connecting portions 24*a* are both arranged on the same side of the contact pin 20 in FIG. 3, the connecting portions 24*a* are arranged on opposite sides of the contact pin 20*a* in FIG. 5. Thus, only two base portions 22*e* and 22*f* are provided, each respectively joined to one of the two depending portions and joined thereto by means of bent portions 24*d* and 24*e* which are respectively bent 180° and 90° as with the connecting portions in FIG. 3.

With the embodiment shown in FIG. 5, the total width of the two depending portions 20*g* and 20*h* are less than the width of the enlarged shoulder portion 20*c* to provide lateral connecting tabs or carrier strips 18', so that adjacent connectors are severed by severing them at the shoulder portions instead of at the bases as is the case with the embodiments shown in FIGS. 1–4. It should be clear, therefore, that the specific locations of the connecting tabs or carrier strips is not critical for purposes of the present invention, and the specific locations of the carrier strips or connecting tabs will least to some extent be a function of the pick and place equipment and, in particular, the design of the feeder used to feed the connectors to the pick and place equipment.

Figure 6:
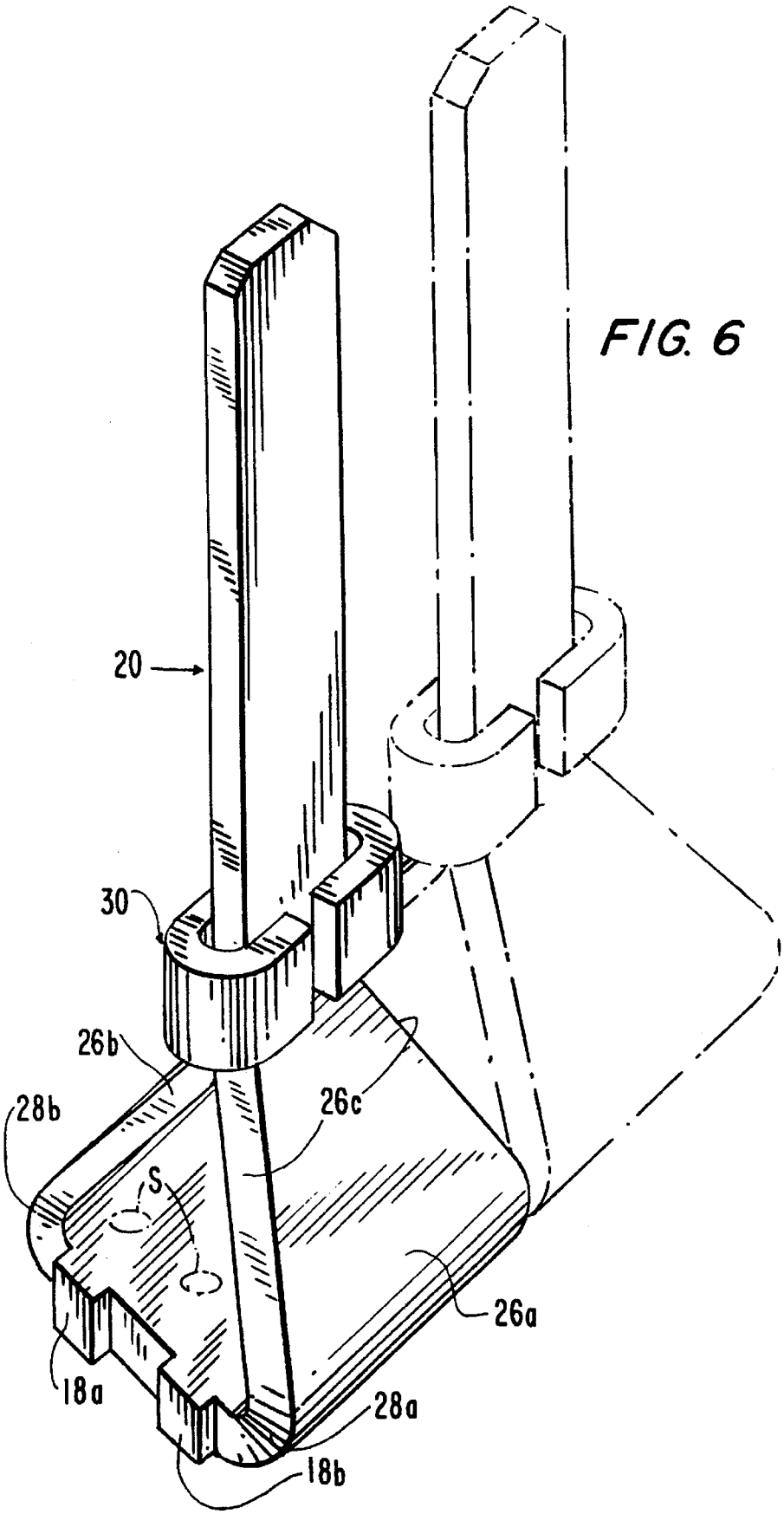
FIG. 6 is yet a further embodiment of a surface mounted connector in accordance with the present invention, in which adjacent connectors are joined to each other by a double set of carrier strips and illustrating a construction for stabilizing the contact pin.

In FIG. 6, a still further contact pin design is illustrated which is similar in certain respects to the pins shown in FIGS. 3–5. However, in FIG. 6, the base 26 is formed of a solid portion of the strip and defines a pair of opposing sides (at the bent portions 28*a*, 28*b*). The contact pin 20 is positioned generally centrally of the rectangular area defined by the base 26. One bent intermediate connecting portion 26*a* extends from one side of the base 26, as shown, to the contact pin 20 and another intermediate connecting portion 26*b* extends from the other side of the base to a point proximate to the contact pin 20. A tab or collar 30 is provided which is crimped about the contact pin 20 as shown. In this manner, the intermediate connecting portions 26*a*, 26*b* stabilize the position of the contact pin 20. Also in FIG. 6, the bases 26 are shown to include a pair of spaced connecting tabs or carrier strips 18*a*, 18*b*, although, clearly, one or more such carrier strips can be provided depending on the equipment to be used and the manner in which the tabs are to be fed to the pick and place equipment. Shown in fanthom are optional holes S in the base 26 to absorb solder during reflow, for reasons discussed above.

Figure 7:
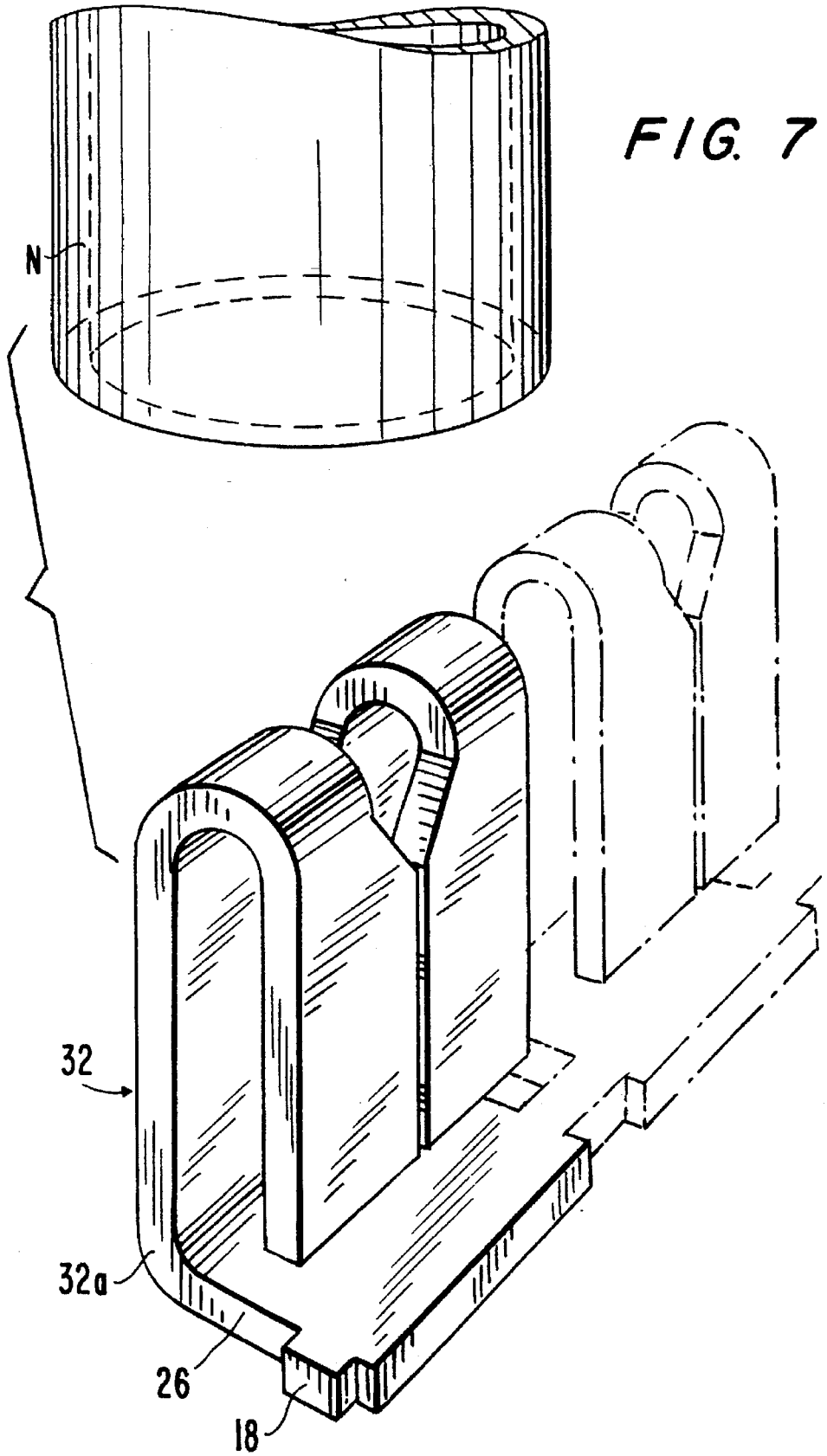
FIG. 7 is similar to FIGS. 3 and 5, but illustrating a surface mounted connector in accordance with the present invention in the form of an insulation displacement connector (IDC)
Figure 8:
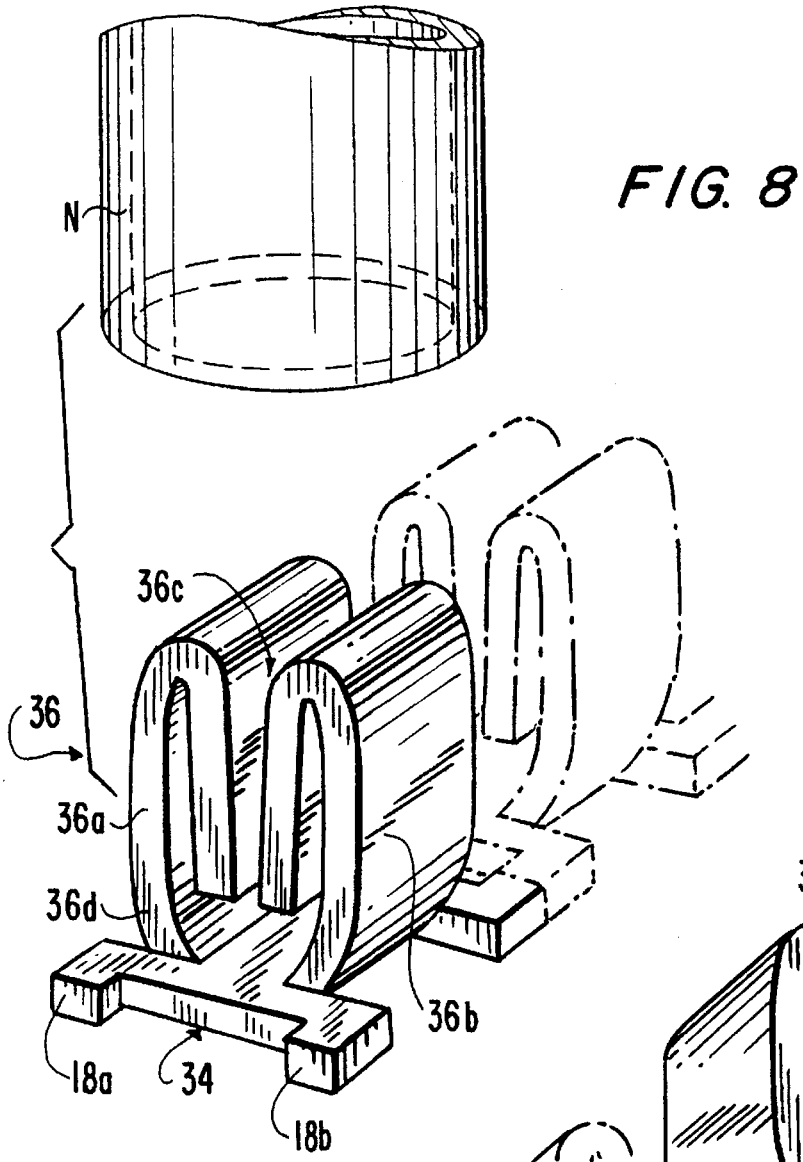
FIG. 8 is similar to FIG. 7, but illustrating a female receptacle for surface mounting in accordance with the present invention.
Figure 9:
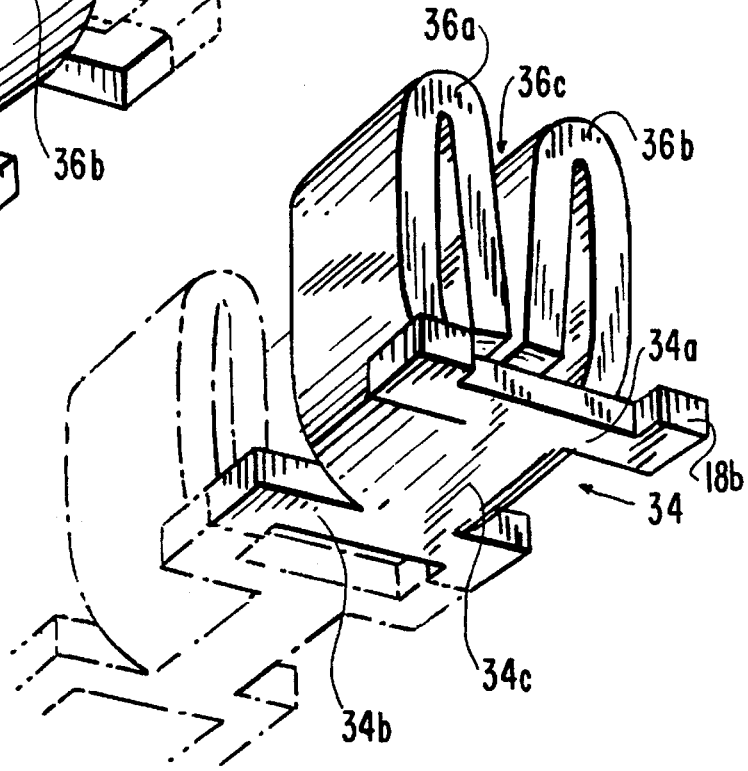
FIG. 9 is a bottom perspective view of the connector shown in FIG. 8 to illustrate details of the base and the manner in which adjacent connectors are joined to each other.

The present invention is not limited to generally elongate contact pins, posts or test points of the type described in FIGS. 1–6. FIG. 7 illustrates an embodiment of the invention in which the contact is in the form of an insulation displacement connector (IDC) 32 connected to the solid base 26 by means of intermediate bent connecting portion 32*a*. The construction of the IDC portion 32 is well known to those skilled in the art. Similarly, in FIG. 8, another type of surface mounted connector is illustrated in the form of a female tab receptacle 36 which includes first and second resilient prongs 36*a*, 36*b* spaced from each other as shown to provide a flat tab receiving space 36*c*. The prongs 36*a* and 36*b* are joined to the base 34, as best shown in FIG. 9. The base 34 is I-shaped and includes transverse base portions 34*a*, 34*b* and a center base portion 34*c*. Each of the prongs 36*a*, 36*b* are joined to the center base portion 34*c*, each of the transverse base portions 34*a*, 34*b* carrying two connecting tabs or carrier strips 18*a*, 18*b*, as shown.

Figure 10:
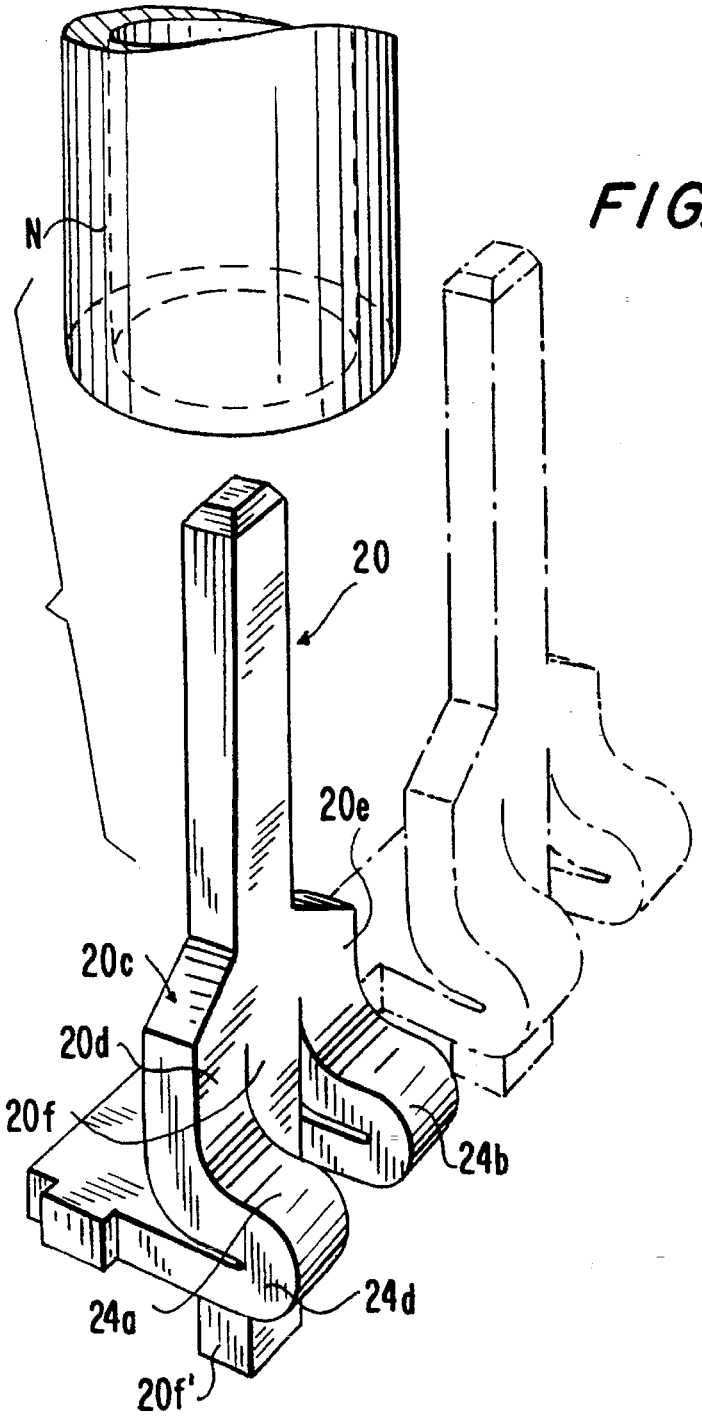
FIG. 10 is similar to FIG. 3, but showing a variant form of the connector which includes a downwardly extending post.
Figure 11:
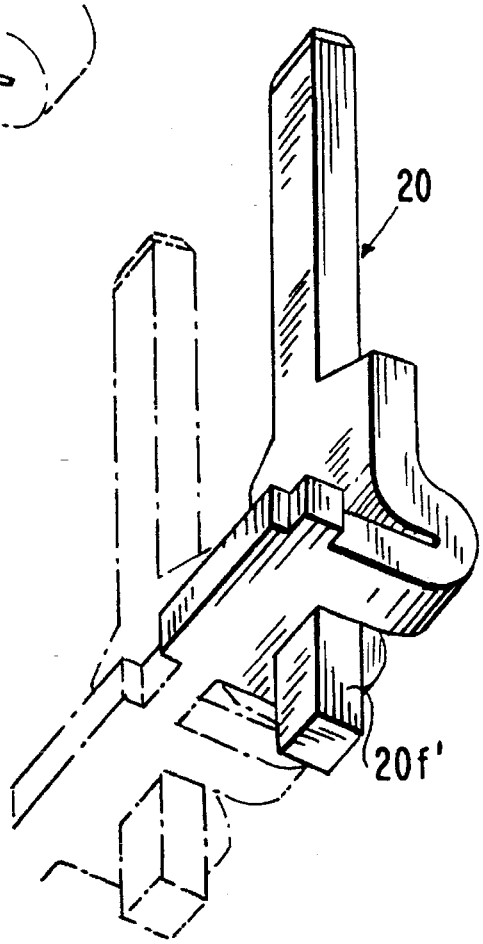
FIG. 11 is a bottom perspective view of the connectors shown in FIG. 10.
Figure 12:
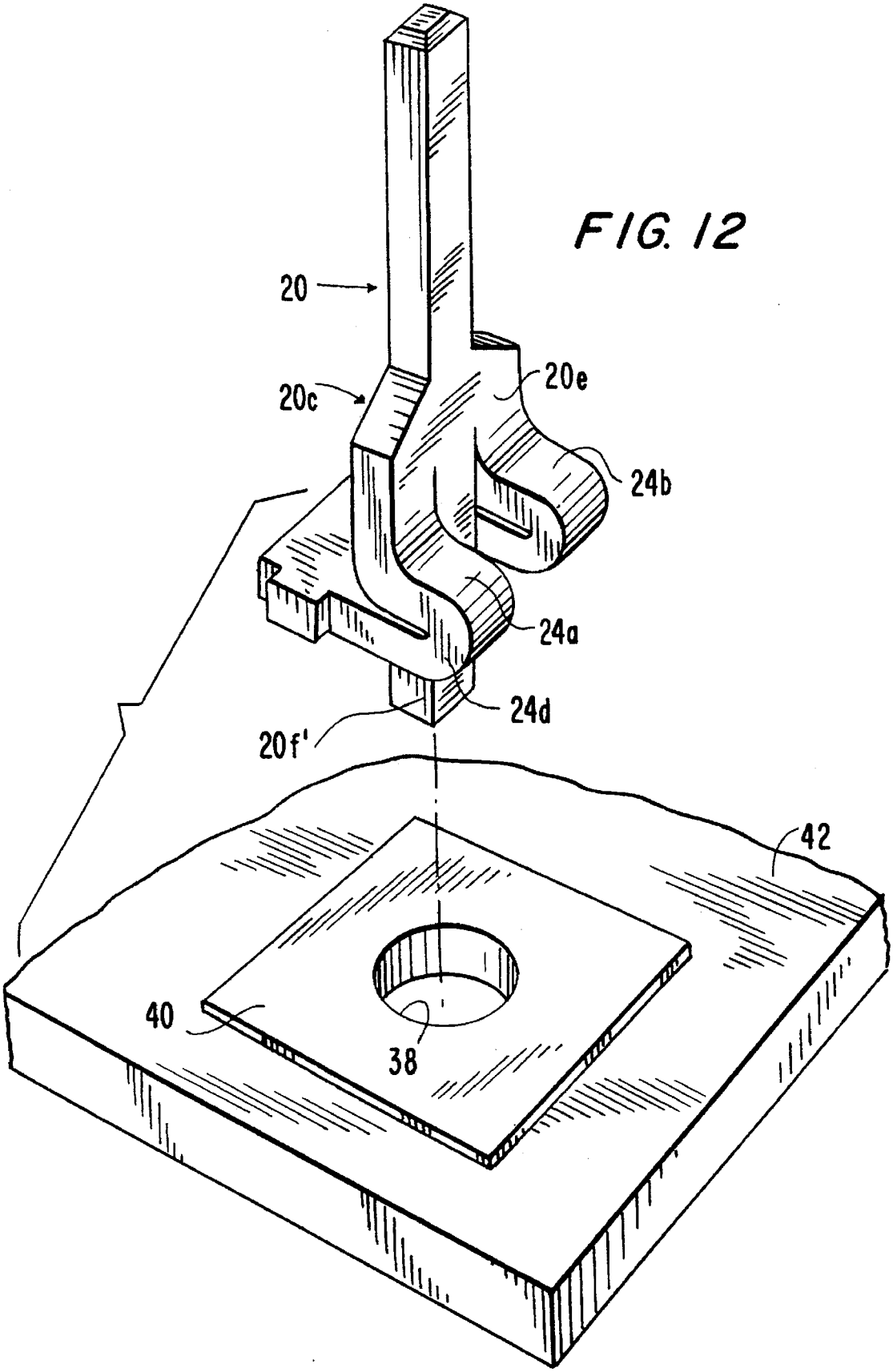
FIG. 12 is an exploded perspective view showing a surface mounted connector of the type shown in FIGS. 10 and 11 just prior to mounting on a printed circuit board which includes a through opening for the post of the connector.

Referring to FIGS. 10–12, a variant of the surface mounted connector in the form of a contact pin is illustrated which is similar in construction to the pin connector shown in FIG. 3. However, instead of the center depending portion 20*f* being bent as shown in FIG. 3 to provide a center base portion 22*d*, the center dependent portion 20*f* extends straight downwardly co-extensively with the contact pin 20 to form a downwardly extending post 20*f* which can be received within a through opening 38 formed in a conductive land or pad of a printed circuit board 42, as shown in FIG. 12. The post or anchor pin protudes downwardly from the flat mounting base. The solder pads 40 of the PCB must have a hole in the center 38 as shown. When the terminal or connector is placed on the side of the paste covered solder pad the anchor post 20*f* enters into the hole or opening 38 and limits the terminal from floating while the solder is reflowed. In most cases, undesired floating is almost totally eliminated as a result of the absorption of solder into spaces S by capillary action as described above.

Figure 13:
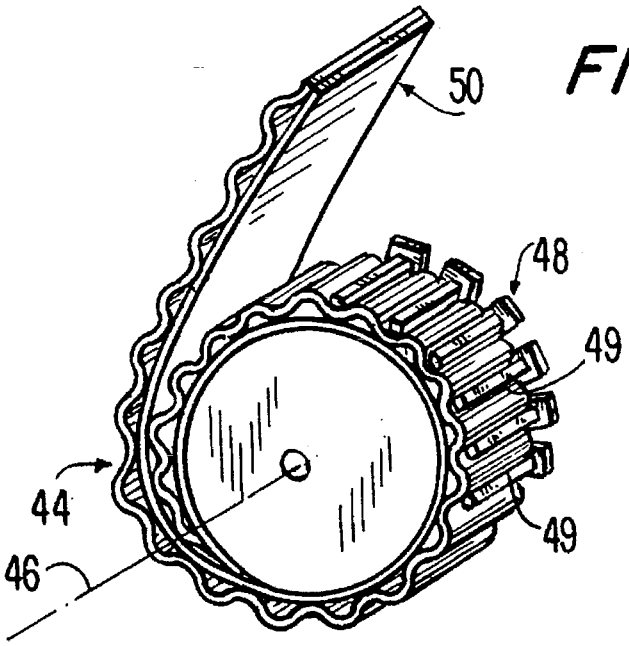
FIG. 13 is a perspective view of a rolled strip of connectors of the type illustrated in FIG. 1, illustrating the orientations of the connectors helically wound on a reel and an interleaf or spacer member for separating adjacent layers of the helical winding.

In FIG. 13, a rolled strip of series-connected surface mounted connectors for automated mounting on a surface of a printed circuit board is illustrated and generally designated by the reference numeral 44. The spool or reel 44 includes a rotatable support member 45 which has an axis of rotation 46. As shown, the surface mounted connectors 48 are oriented so that the directions of the contacts 49 are substantially parallel to the axis of rotation 46 while the bases of the individual connectors are substantially arranged in a common or in parallel planes. The frangible connecting means in the form of connecting tabs or carrier strips are sufficiently flexible without breaking to allow the connectors 48 to be arranged along circular arcs when helically wound about the support member 45.

Figure 14:
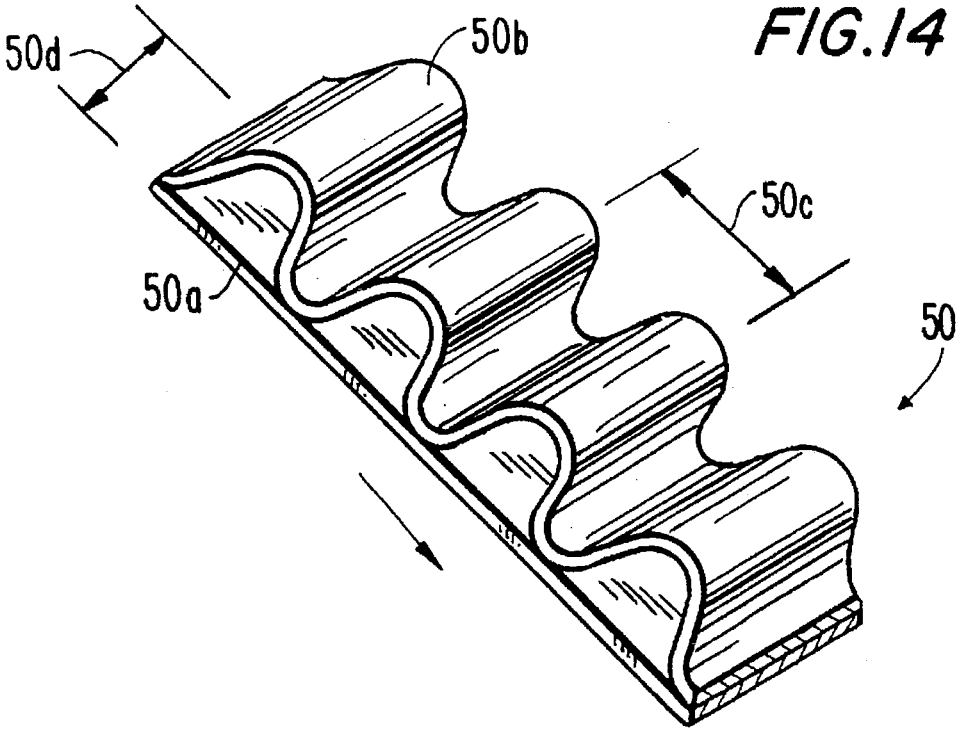
FIG. 14 is an enlarged perspective view of a section of the spacer member used in the rolled strip shown in FIG. 13.

Since the radial dimensions of the elongate contact pins (when wound on the spool or reel 44) are generally less than those of the bases of such connectors, it is preferred that a suitable spacer element be provided which is interleafed with the continuous helically wound strip of connectors for maintaining the electrical contacts in the desired parallel orientations as shown. Referring to FIG. 14, there is shown one form of spacer that can be used for maintaining the contacts 49 in adjacent layers spaced from each other at a distance to define a spiral connector-receiving space which has a radial dimension substantially equal to the radial dimension of the bases of the connectors. A suitably dimensioned spiral connector receiving space minimizes contact interference between the bases in adjacent layers. The illustrated spacer includes a continuous flat strip of flexible material 50*a*, and an undulating wave-like or corrugated strip of material 50*b* which is attached to the flat strip of material 50*a* as shown. The wave-like strip of material 50*b* has a peak-to-peak distance 50*c* along the length of the flat strip 50*a* which substantially corresponds to the distance between successive contacts 48 on the strip, and a peak-to-peak height 50*d* along a radial direction normal to the longitudinal direction of the flat strip which is subtantially equal to the difference between the radial dimension of the bases and the dimension of the contacts 49 in the radial direction when helically wound on the rotatable support member 45. The spacer 50 normally secures the contacts on the reel. By unwinding the spacer during use, a section of the continuous strip can be unwound and fed to a pick and place machine. A spool or reel of the type shown in FIG. 13 can be mounted on a feeder of the type shown and described in U.S. Pat. application Ser. No. ,assigned to the assignee of the present application. The specific construction of the spacer 50 is not critical and, in theory, the continuous strip of surface mounted connectors can be helically wound without the use of a spacer or simply separated by a continuous strip of flat sheet material. However, the use of the spacer maintains the desired orientations of the connectors 48 and prevents the connecting tabs or carrier strips from becoming damaged or severed.

In FIGS. 15 and 16 a further embodiment is illustrated which incorporates the invention and is in the form of a fuse holder 60. The fuse holder 60 has a base 62 similar to the base shown in FIGS. 8 and 9. Spring clips 60*a*, 60*b* extend normally from the base and integrally joined thereto at bent portions 64*a*, 64*b* as shown. As with the other surface connectors, the bases are preferably provided with apertures or opening S for receiving solder by capillary action. Some solder will also enter the spaces S in the regions of the bent portions 64*a*, 64*b*.

Although the present invention has fully been described in connection with the preferred embodiments thereof with reference to the accompanying drawings, it is to be noted that various changes and modifications are apparent to those skilled in the art. Such changes and modifications are to be understood as included within the scope of the present invention as defined in the claims that follow.

I claim:

1. A surface mounted connector for surface mounting on a generally flat conductive surface of a printed circuit board, the connector comprising a base defining a plane and forming a generally flat substantially solid surface defining a predetermined area suitable for contact with and attachment to an associated flat conductive surface of the printed circuit board; a contact having at least one portion projecting from said base in a direction substantially normal to said plane defined by said base; at least one bent intermediate connecting portion integrally connecting said contact to said base, said contact, base and at least one bent intermediate connecting portion all being formed of a generally flat sheet of conductive material, said base being provided with aperture means forming spaces defining areas substantially smaller than said predetermined area for promoting flow of solder on the conductive surface of the printed circuit board into said spaces by capillary action upon heating and reflow of the solder.

2. A surface mounted connector as defined in claim 1, wherein said contact is a contact pin.

3. A surface mounted connector as defined in claim 1, wherein said contact is an electrical female receptacle.

4. A surface mounted connector as defined in claim 1, wherein said contact is an electrical insulation displacement connector.

5. A surface mounted connector as defined in claim 1, wherein said contact is a fuse clip.

6. A surface mounted connector for surface mounting on a generally flat conductive surface of a printed circuit board, the connector comprising a base defining a plane and having a generally flat surface suitable for contact with an attachment to an associated flat conductive surface of the printed circuit board; a contact having at least one portion projecting from said base in a direction substantially normal to said plane defined by said base; and at least one bent intermediate connecting portion integrally connecting said contact to said base, said contact, base and at least one bent intermediate connecting portion all being formed of a generally flat sheet of conductive material, wherein said base comprises two base portions and said contact comprises two elongate substantially juxtaposed contact portions each having ends respectively proximate and remote in relation to said base, said remote ends being joined to each other by an integral bent bridging portion, two bent intermediate connecting portions being provided each connecting one of said proximate ends to an associated one of said base portions.

7. A surface mounted connector as defined in claim 6, wherein one base comprises a U-shaped member having a transverse segment and two parallel segments each joined at one end to said transverse segments and having free ends, said other base portion being dimensioned and configurated to substantially conform to and occupy an area between said free ends.

8. A surface mounted connector as defined in claim 7, wherein one bent intermediate connecting portion is connected to said transverse segment and another bent intermediate connecting portion is connected to said other base portion.

9. A surface mounted connector as defined in claim 6, wherein each of said two bent portions are bent approximately 90°.

10. A surface mounted connector as defined in claim 1, wherein said base comprises a plurality of base portions and said contact comprises a contact pin remote from said base and a plurality of depending portions equal to the number of base portions substantially coplanar with said contact pin and proximate to said base; a separate bent intermediate connecting portion connecting each depending portion with an associate base portion.

11. A surface mounted connector as defined in claim 10, wherein three base portions and three depending portions are provided, and three bent intermediate connecting portions are provided each joining associated based and depending portions.

12. A surface mounted connector as defined in claim 11, wherein one of the depending portions is a central depending portion substantially coextensive with said central contact pin and two of the depending portions are arranged to the sides of said central depending portion, the bent connecting portion for the central depending portion being bent approximately 90° while the bent connecting portions for the side depending portions are bent approximately 180°.

13. A surface mounted connector as defined in claim 10, wherein two base portions and two depending portions are provided, and two bent intermediate connecting portions are provided each joining associated base and depending portions.

14. A surface mounted connector as defined in claim 13, wherein said two bent intermediate connecting portions are each bent approximately 180°.

15. A surface mounted connector as defined in claim 1, wherein said base is substantially rectangular and defines a pair opposing sides, said contact being positioned generally centrally of the rectangular area of said base, one bent intermediate connecting portion extends from one side of said base to said contact and another intermediate connecting portion extending from the other side of said base to a point proximate to said contact, and further including a tab or collar crimped about said contact, whereby said intermediate connecting portions stabilize the position of said contact.

16. A surface mounted connector as defined in claim 1, further comprising a post projecting from said base in a direction substantially normal to said plane defined by said base and opposite to the direction of said contact, whereby said post can be received within a through opening in the printed circuit board when the connector is surface mounted thereon.

17. A strip of series connected surface mounted connectors for automated mounting on a surface of a printed circuit board, each connector comprising a base defining a plane and forming a generally flat substantially solid surface defining a predetermined area suitable for contact with and attachment to an associated flat conductive surface of the printed circuit board; a contact having at least one portion projecting from said base in a direction substantially normal to said plane defined by said base; and at least one bent intermediate connecting portion integrally connecting said contact to said base, said contact base and at least one bent intermediate connecting portion all being formed of a generally flat sheet of conductive material, said base being provided with aperture means forming spaces defining areas substantially smaller than said predetermined area for promoting flow of solder on the conductive surface of the printed circuit board into said spaces by capillary action upon heating and reflow of the solder; and frangible connecting means between each two adjacent connectors, whereby a strip of connectors can be advanced to an automated mounting station and a connector at the downstream end of the strip can be separated from the strip by severing said frangible connecting means between said connector at the downstream end and an adjacent immediately succeeding connector in the strip.

18. A strip of connectors as defined in claim 17, wherein said frangible connecting means comprises connecting tabs integrally formed with the bases of each two adjoining connectors.

19. A strip of connectors as defined in claim 17, wherein said frangible connecting means comprises connecting tabs integrally formed with the contacts of each two adjoining connectors.

20. A rolled strip of series connected surface mounted connectors for automated mounting on a surface of a printed circuit board, each connector comprising a base defining a plane and forming a generally flat substantially solid surface defining a predetermined area suitable for contact with and attachment to an associate flat conductive surface of the printed circuit board; a contact having at least one portion projecting from said base in a direction substantially normal to said plane defined by said base; and at least one bent intermediate connecting portion integrally connecting said contact to said base, said contact, base and at least one bent intermediate connecting portion all being formed of a generally flat sheet of conductive material, said base being provided with aperture means forming spaces defining areas substantially smaller than said predetermined area for promoting flow of solder on the conductive surface of the printed circuit board into said spaces by capillary action upon heating and reflow of the solder; frangible connecting means between each two adjacent connectors; and a rotatable support member on which the strip of connectors is helically wound, said rotatable support member defining an axis of rotation, said connectors being oriented so that said contacts extend in directions substantially parallel to said axis of rotation, said frangible connecting means being sufficiently flexible without breaking to allow said connectors to be arranged along circular arcs when helically wound about said support member.

21. A rolled strip of connectors as defined in claim 20, wherein said bases of said connectors have a predetermined dimension in the radial direction when helically wound on said rotatable support member; and further comprising spacer means for maintaining said contacts in adjacent layers spaced from each other at a distance to define a spiral connector-receiving space having a radial dimension substantially equal to said predetermined dimensions, whereby the rolled strip of connectors can be received within the spiral connector receiving space with minimal contact interference between bases in adjacent layers.

22. A blank for a surface mounted connector comprising a stamping from a flat sheet of electrically conductive material and including in a common plane at least one base portion defining a predetermined area creating a generally flat substantially solid surface upon formation of the connector from the blank and being suitable for attachment to an associated surface of a printed circuit board; a contact, and at least one intermediate connecting portion integrally connecting said contact to said base portion, whereby at least one portion of said contact can be moved to a position substantially normal to said plane by bending said at least one intermediate connecting portion to form the surface mounted connector, said base being provided with aperture means forming spaces defining areas substantially smaller than said predetermined area for promoting flow of solder on the conductive surface of the printed circuit board into said spaces by capillary action upon heating and reflow of the solder.

23. A blank for a plurality of series-connected surface mounted connectors comprising a stamping from an elongated strip of a flat sheet of electrically conductive material which includes a plurality of blank portions successively stamped along said strip; and at least one frangible tab between adjacent blank portions connecting adjacent blank portions to each other, each blank portion comprising at least one base portion defining a predetermined area creating a generally flat substantially solid surface upon formation of the connector from the blank and being suitable for attachment to an associated surface of a printed circuit board; a contact; and at least one intermediate connecting portion integrally connecting said contact to said base portion, whereby at least one portion of said contact can be moved to a position substantially normal to said plane by bending said at least one intermediate connecting portion to form the surface mounted connector, whereby two adjacent surface mounted connectors can be separated from each other by severing the tab connecting the same, said base being provided with aperture means forming spaces defining areas substantially smaller than said predetermined area for promoting flow of solder on the conductive surface of the printed circuit board into said spaces by capillary action upon heating and reflow of the solder.

24. A method of forming a surface mounted connector, comprising the steps of forming a blank from a flat sheet of electrically conductive material to form, in a common plane, at least one base portion creating a generally flat substantially solid surface defining a predetermined area upon formation of the connector from the blank and being suitable for attachment to an associated surface of a printed circuit board; a contact; and at least one intermediate connecting portion integrally connecting said contact to said base portion; and deforming the blank by moving at least one portion of the contact to a position substantially normal to said plane by bending said at least one intermediate connecting portion to form the surface mounted connector said base being provided with aperture means forming spaces defining areas substantially smaller than said predetermined area for promoting flow of solder on the conductive surface of the printed circuit board into said spaces by capillary action upon heating and reflow of the solder.

25. A surface mounted connector formed by the steps of forming a blank from a flat sheet of electrically conductive material to form, in a common plane, at least one base portion creating a generally flat substantially solid surface defining a predetermined area upon formation of the connector from the blank and being suitable for attachment to an associated surface of a printed circuit board; a contact; and at least one intermediate connecting portion integrally connecting said contact to said base portion; and deforming the blank by moving at least one portion of the contact to a position substantially normal to said plane by bending said at least one intermediate connecting portion to form the surface mounted connector, said base being provided with aperture means forming spaces defining areas substantially smaller than said predetermined area for promoting flow of solder on the conductive surface of the printed circuit board into said spaces by capillary action upon heating and reflow of the solder.

26. A rolled strip of series connected surface mounted connectors for automated mounting on a surface of a printed circuit board, each connector comprising a base defining a plane; and having a generally flat surface suitable for contact with an attachment to an associated flat conductive surface of the printed circuit board; a contact having at least one portion projecting from said base in a direction substantially normal to said plane defined by said base; and at least one bent intermediate connecting portion integrally connecting said contact to said base, said contact, base and at least one bent intermediate connecting portion all being formed of a generally flat sheet of conductive material; frangible connecting means between each two adjacent connectors; and a rotatable support member on which the strip of connectors is helically wound, said rotatable support member defining an axis of rotation, said connectors being oriented so that said contacts extend in directions substantially parallel to said axis of rotation, said frangible connecting means being sufficiently flexible without breaking to allow said connectors to be arranged along circular arcs when helically wound about said support member, wherein said bases of said connectors have a predetermined dimension in the radial direction when helically wound on said rotatable support member; and further comprising spacer means for maintaining said contacts in adjacent layers spaced from each other at a distance to define a spiral connector-receiving space having a radial dimension substantially equal to said predetermined dimensions, whereby the rolled strip of connectors can be received within the spiral connector receiving space with minimal contact interference between bases in adjacent layers, and wherein said spacer means comprise a continuous flat strip of flexible material; and an undulating wave-like strip of material attached to said flat strip of material having a peak-to-peak distance along the length of said flat strip substantially corresponding to the distance between successive contacts in the strip, and a peak-to-peak height along a radial direction normal to said flat strip substantially equal to the difference between said predetermined radial dimension and the dimension of said contact in the radial direction when helically wound on said rotatable support member.

* * * * *